US006097934A

United States Patent [19]

Spall et al.

[11] Patent Number: 6,097,934

[45] Date of Patent: Aug. 1, 2000

[54] RETRACTABLE RADIOTELEPHONE ANTENNAS WITH EXTENDED FEEDS

[75] Inventors: John M. Spall, Raleigh; Gerard J. Hayes, Wake Forest; Howard E. Holshouser, Efland, all of N.C.

[73] Assignee: Ericsson Inc., Research Triangle Park, N.C.

[21] Appl. No.: 09/001,870

[22] Filed: Dec. 31, 1997

[51] Int. Cl.[7] ..... H01Q 1/24

[52] U.S. Cl. ..... 455/90; 455/550; 455/575; 343/702

[58] Field of Search ..... 343/702, 792, 343/790, 877; 455/97, 89, 575, 550, 90

[56] References Cited

U.S. PATENT DOCUMENTS

| | | | |
|---|---|---|---|
| 4,121,218 | 10/1978 | Irwin et al. | 343/702 |
| 5,079,562 | 1/1992 | Yarsunas et al. | 343/792 |
| 5,343,213 | 8/1994 | Kottke et al. | 343/702 |
| 5,374,937 | 12/1994 | Tsunekawa et al. . | |
| 5,513,383 | 4/1996 | Tsao | 455/89 |
| 5,659,889 | 8/1997 | Cockson | 455/575 |
| 5,717,409 | 2/1998 | Garner et al. | 343/702 |
| 5,774,794 | 6/1998 | Kido | 455/97 |
| 5,794,158 | 8/1998 | Itoh | 455/550 |
| 5,812,097 | 9/1998 | Maldanado | 343/790 |
| 5,835,070 | 11/1998 | Scarglino | 343/877 |
| 5,836,005 | 11/1998 | Chang | 343/702 |
| 5,856,808 | 1/1999 | Holshouser et al. | 343/702 |

FOREIGN PATENT DOCUMENTS

| | | |
|---|---|---|
| 0 427 654 | 5/1991 | European Pat. Off. . |
| 0 590 534 | 4/1994 | European Pat. Off. . |
| 0 718 909 | 6/1996 | European Pat. Off. . |
| 0 736 925 | 10/1996 | European Pat. Off. . |
| 43 27 955 | 2/1995 | Germany . |
| 0 895 299 | 4/1997 | WIPO . |
| 97/39493 | 4/1997 | WIPO . |

*Primary Examiner*—William G. Trost
*Assistant Examiner*—Temica M. Davis
*Attorney, Agent, or Firm*—Myers Bigel Sibley & Sajovec

[57] ABSTRACT

Radiotelephones having retractable antenna systems include an antenna, a housing with a transceiver and user interface disposed therein and a non-radiating antenna feed coupled to both the antenna and the transceiver. The non-radiating feed is movably mounted within and extendible from the housing so as to have an extended position and a retracted position. In one embodiment, the antenna is physically supported by the non-radiating feed and is thus mounted in an extended state when the non-radiating feed is in an extended position. and is mounted in a retracted state when the non-radiating feed is in the retracted position. Preferably, the antenna exhibits approximately the same electrical length in both the extended and retracted states, and the antenna is substantially isolated from the housing of the radiotelephone when the antenna is in the extended state.

14 Claims, 7 Drawing Sheets

RETRACTABLE RADIOTELEPHONE ANTENNAS WITH EXTENDED FEEDS

FIELD OF THE INVENTION

The present invention relates generally to radiotelephones, and, more particularly, to retractable antenna systems for use with portable radiotelephones.

BACKGROUND OF THE INVENTION

Radiotelephones, which are well known in the art, generally refer to communications terminals which can provide a wireless communications link to one or more other communications terminals. Such radiotelephones are used in a variety of different applications, including cellular telephone, land-mobile (e.g., police and fire departments), and satellite communications systems.

Many radiotelephones, and in particular handheld radiotelephones, employ retractable antennas which may be extended out of, and retracted back into, the radiotelephone housing. Typically, such retractable antennas are electrically connected to a printed circuit board located within the housing of the radiotelephone that contains signal processing and other radio frequency circuitry. In order to maximize the transfer of power between the antenna and this radio frequency circuitry, the antenna and the radio frequency circuitry are typically interconnected such that the impedance of the antenna and the signal processing circuit are substantially matched. As many radiotelephones use 50 ohm impedance coaxial cable or microstrip transmission lines to connect the antenna to the radio frequency circuit, such matching typically comprises mechanically adjusting or electrically tuning the antenna so that it exhibits an impedance of approximately 50 ohms at its connection with the coaxial cable or microstrip transmission line.

Unfortunately, however, matching the impedance of a retractable antenna is more difficult, as the impedance exhibited by the antenna is generally dependent on the position of the antenna with respect to both the housing of the radiotelephone and the printed circuit board which contains the radio frequency circuitry. As these respective positions change when the antenna is moved between the extended and retracted positions, the antenna typically exhibits at least two different impedance states, both of which should be matched to the 50 ohm impedance of the feed from the printed circuit board. Accordingly, with retractable antennas, it is generally necessary to provide an impedance matching system that provides an acceptable impedance match between the antenna and the radio frequency circuitry both when the antenna is retracted and extended.

While it is generally desirable to optimally match the impedances of the antenna and the radio frequency circuitry, countervailing concerns are the physical size and expense associated with providing such matching. Most popular handheld telephones are undergoing miniaturization, such that many contemporary radiotelephones are as small as 11–12 centimeters in length, with correspondingly smaller printed circuit boards. Unfortunately, as the printed circuit board decreases in size, the amount of space which is available to support desired operational and performance parameters of the radiotelephone, including the space available for any impedance matching circuitry, is generally reduced. Thus, it is preferable that any matching circuit or components use, at most, minimal space on the radio frequency printed circuit board.

A number of different matching techniques are conventionally used with retractable antennas. For instance, many radiotelephones with retractable antennas employ dual impedance matching circuits, one of which is associated with the extended antenna position and the other with the retracted position. These matching systems typically comprise two or more resonant circuits and switches for switching between these circuits as a function of the position of the antenna. Other radiotelephones only provide a single matching circuit (which is switched in when the antenna is in the extended position), and operate without the benefit of any matching circuit when the antenna is in the retracted position. In other designs, a full half-wavelength ($\lambda/2$) antenna may be used so that the antenna radiates as a full half-wavelength structure in the extended position and as a quarter-wavelength ($\lambda/4$) antenna in the retracted position (as the retracted portion of the antenna does not radiate). With this arrangement, impedance matching is typically only required in the extended position, as the antenna may be designed to have a natural impedance reasonably close to 50 ohms in the retracted position. Still other radiotelephones use parasitic elements or printed transformer segments to match the impedance of the antenna to the radio frequency circuit board. However, each of the aforementioned techniques require some sort of matching means, which in turn requires space within the housing (or antenna) for matching components, and which additionally increases the overall cost of manufacturing the radiotelephone.

The aforementioned matching problems are further compounded in "dual-band" radiotelephones that are designed to transmit and receive signals in two or more widely separated frequency bands, such as the radiotelephones used with various satellite communications systems that employ widely separated transmit and receive frequency bands. As the impedance seen at the base of the antenna is usually a function of frequency, antenna systems for such dual-band radiotelephones typically require separate matching networks for each of the two frequency bands of operation. Accordingly, if retractable antennas are used on such radiotelephones, it is often necessary to provide as many as four matching networks to ensure that an acceptable impedance match is achieved at each frequency of operation and each possible antenna position (i.e., extended or retracted).

In addition to impedance matching problems, the performance of radiotelephones may also be negatively impacted by interactions between the antenna system and the housing of the radiotelephone, whereby energy is coupled from the antenna to the chassis of the phone where it is dissipated as heat. Similarly, the user of the telephone may also negatively impact the gain performance of the radiotelephone antenna if the user is sufficiently close to the antenna during operation of the radiotelephone. Accordingly, it may also be desirable to increase the isolation between the radiating structure and the chassis of the radiotelephone, to minimize the performance degradation resulting from these antenna/phone and antenna/user interactions.

In light of the above-mentioned problems with existing radiotelephone antenna systems, a need exists for radiotelephones with antenna systems that require minimal physical space within the housing of the radiotelephone for impedance matching purposes and which minimize the impact the chassis of the radiotelephone or the user may have on the performance of the antenna system.

SUMMARY OF THE INVENTION

In view of the above limitations associated with existing retractable antenna systems for radiotelephones, it is an object of the present invention to provide retractable antenna systems which are conveniently small and which minimize the amount of radio frequency circuitry required.

Another object of the present invention is to provide retractable antenna systems which provide improved performance by enhancing the isolation between the antenna and the radiotelephone when the antenna is operated in the extended position.

It is still a further object of the present invention to provide retractable radiotelephone antenna systems which provide enhanced gain by providing increased isolation between the antenna and the user.

Additional objects, features and advantages of the present invention will become apparent upon reading the following detailed description and appended claims and upon reference to the accompanying drawings.

These and other objects of the present invention are provided by retractable antenna systems which comprise an antenna coupled to an extendible, non-radiating feed line.

When the antenna is in the retracted position, this non-radiating feed line is mostly, or completely, located within the housing of the radiotelephone, whereas when the radiotelephone operates with the antenna in the extended position, most, or all, of the non-radiating feed line is pulled outside of the housing, thereby extending the antenna well away from the body of the radiotelephone. As only a non-radiating structure is retracted into the housing of the radiotelephone, the electrical length of the antenna is essentially the same regardless of whether or not the antenna is extended. As such, the antenna exhibits approximately the same impedance in both the extended and retracted positions, and, thus, the antenna systems of the present invention reduce or eliminate the need for additional impedance matching components. Moreover, by raising the base of the radiating structure to a point above the housing of the radiotelephone when operating in the extended position, the antenna systems of the present invention minimize undesirable coupling between the antenna and both the phone and the user.

In one embodiment of the present invention, a radiotelephone having a retractable antenna system is provided which includes a housing, a transceiver disposed within the housing, a user interface which is electrically coupled to the transceiver, a non-radiating feed movably mounted within the housing and extendible from the housing so as to have an extended position and a retracted position, and an antenna. The non-radiating feed is electrically coupled to the antenna, and connection means are provided for electrically coupling the transceiver to the non-radiating feed. In one embodiment, the antenna is physically supported by the non-radiating feed and is thus mounted in an extended state when the non-radiating feed is in an extended position, and is mounted in a retracted state when the non-radiating feed in the retracted position. Preferably, the antenna exhibits approximately the same electrical length in both the extended and retracted states, and the antenna is substantially isolated from the housing of the radiotelephone when the antenna is in the extended state.

The radiotelephone may further include means for grounding the non-radiating feed when the non-radiating feed is in a retracted position. Moreover, when the antenna is in the extended state, the antenna may be fed by the non-radiating feed at a point external to the housing of the radiotelephone.

In another embodiment of the present invention, the antenna system may further include a ground plane connected adjacent one end of the non-radiating feed and movable with the non-radiating feed. In this embodiment, the ground plane is preferably located external to the radiotelephone when the antenna is in the extended state.

In still another aspect of the present invention, a dual-band antenna may be provided such that the antenna may be excited to radiate in a selected one of two separate frequency bands responsive to an excitation signal from the transceiver. In this embodiment, the length of the non-radiating feed line is preferably approximately ¼ the wavelength corresponding to the center frequency of the lower of the frequency bands in which the dual-band antenna radiates.

Thus, the retractable antenna systems of the present invention avoid the need for matching components, and, thus, may be designed to be smaller and more economical than prior art systems. Moreover, as the ground plane of the antenna in the extended position is raised above the housing of the radiotelephone, the antenna systems of the present invention advantageously maximize gain performance by minimizing the interactions between the antenna and the phone and user.

BRIEF DESCRIPTION OF THE DRAWINGS

FIG. 5(*b*) is a top view of the extendible non-radiating feed and certain of the connections between it and the radio frequency board in the embodiment of FIG. 5(*a*);

FIG. 5(*c*) is a front view of the extendible non-radiating feed and certain of the connections between it and the radio frequency board in the embodiment of FIG. 5(*a*);

FIG. 6(*b*) is a bottom view of the extendible non-radiating feed and the remaining ground connection in the embodiment of FIG. 5(*a*);

FIG. 6(*c*) is a front view of the extendible non-radiating feed and the remaining ground connection in the embodiment of FIG. 5(*a*)

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Additionally, it will be understood by those of skill in the art that the present invention may be advantageously used in a variety of applications, and thus the present invention should not be construed as limited in any way to the example applications described herein. Like numbers refer to like elements throughout.

Figure 1:
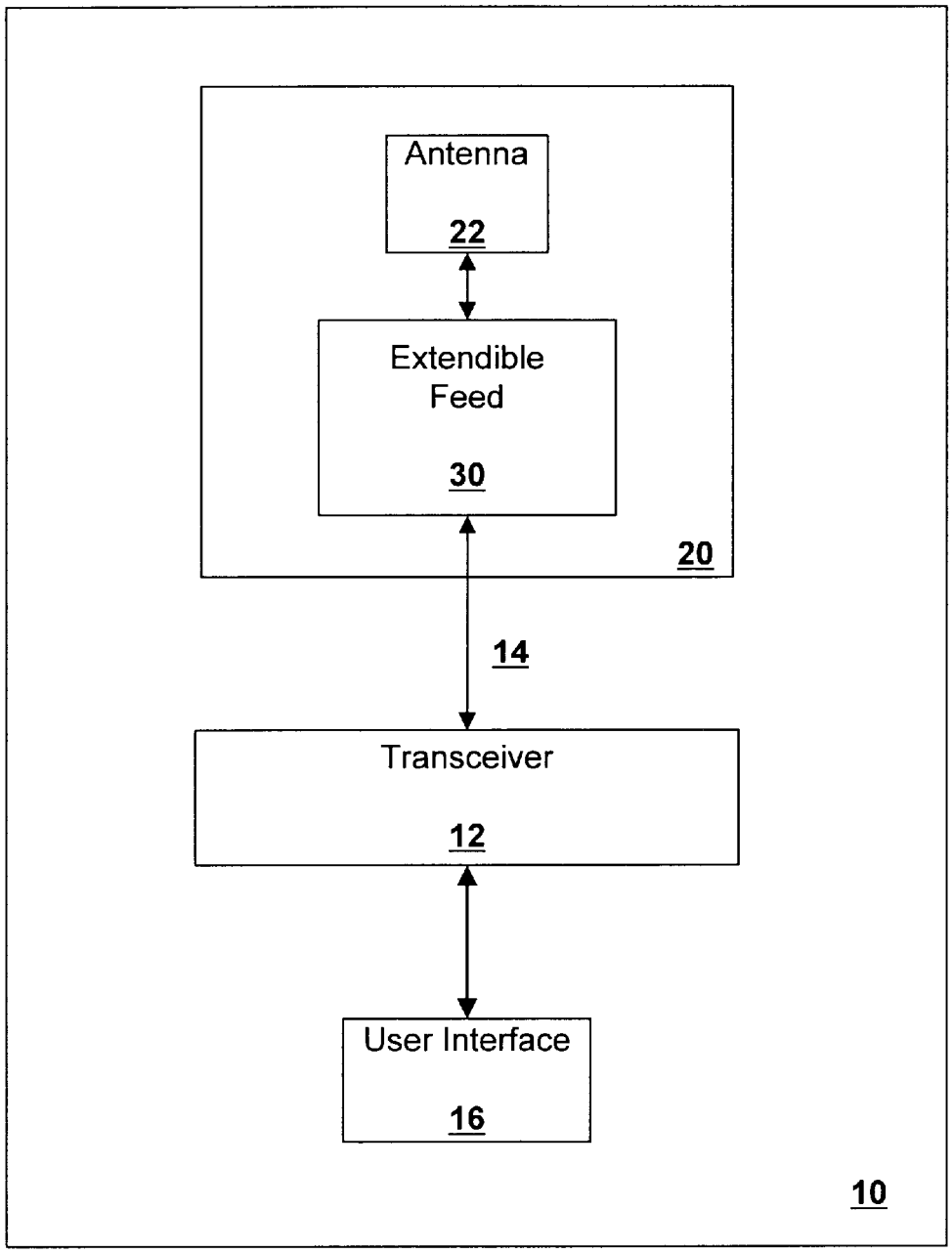
FIG. 1 is a block diagram of a radiotelephone which includes a retractable antenna system according to the present invention.

An embodiment of a radiotelephone 10 which includes a retractable antenna system 20 according to the present invention is illustrated in FIG. 1. Radiotelephone 10 may comprise any type of wireless radio voice or data communications terminal, such as, for example, a satellite communications terminal, a handheld cellular telephone, or a citizens-band radio transceiver.

As shown in FIG. 1, radiotelephone 10 typically includes a transceiver 12, a user interface 16 and an antenna feed 14. As is well known to those of skill in the art, transceiver 12 facilitates the radio frequency transmission of information by converting information which is to be transmitted into electromagnetic signals suitable for radio communications. Transceiver 12 also may be used to demodulate electromagnetic signals which are received by radiotelephone 10, thereby providing the information contained in the signals to user interface 16. Antenna feed 14 couples electromagnetic energy between transceiver 12 and antenna system 20. A wide variety of transceivers 12, antenna feeds 14 (e.g., microstrip, coaxial cable, stripline) and user interfaces 16 (e.g., microphones, keypads, rotary dials) which are suitable for use with radiotelephones 10 are known to those of skill in the art, and will not be described further herein.

As illustrated in FIG. 1, retractable antenna system 20 includes an antenna 22 and an extendible, non-radiating feed 30. In one embodiment of the present invention, antenna feed 14 is coupled to extendible feed 30 which in turn is coupled to antenna 22. Antenna 22 may be any antenna suitable for use with radiotelephones, including a large variety of monopole, dipole, patch, helical and multifilar helical antennas. In one embodiment of the present invention, antenna 22 is a dual-band helix antenna, implemented either as concentric helix antennas or as a helix antenna with a parasitic element.

Figure 2:
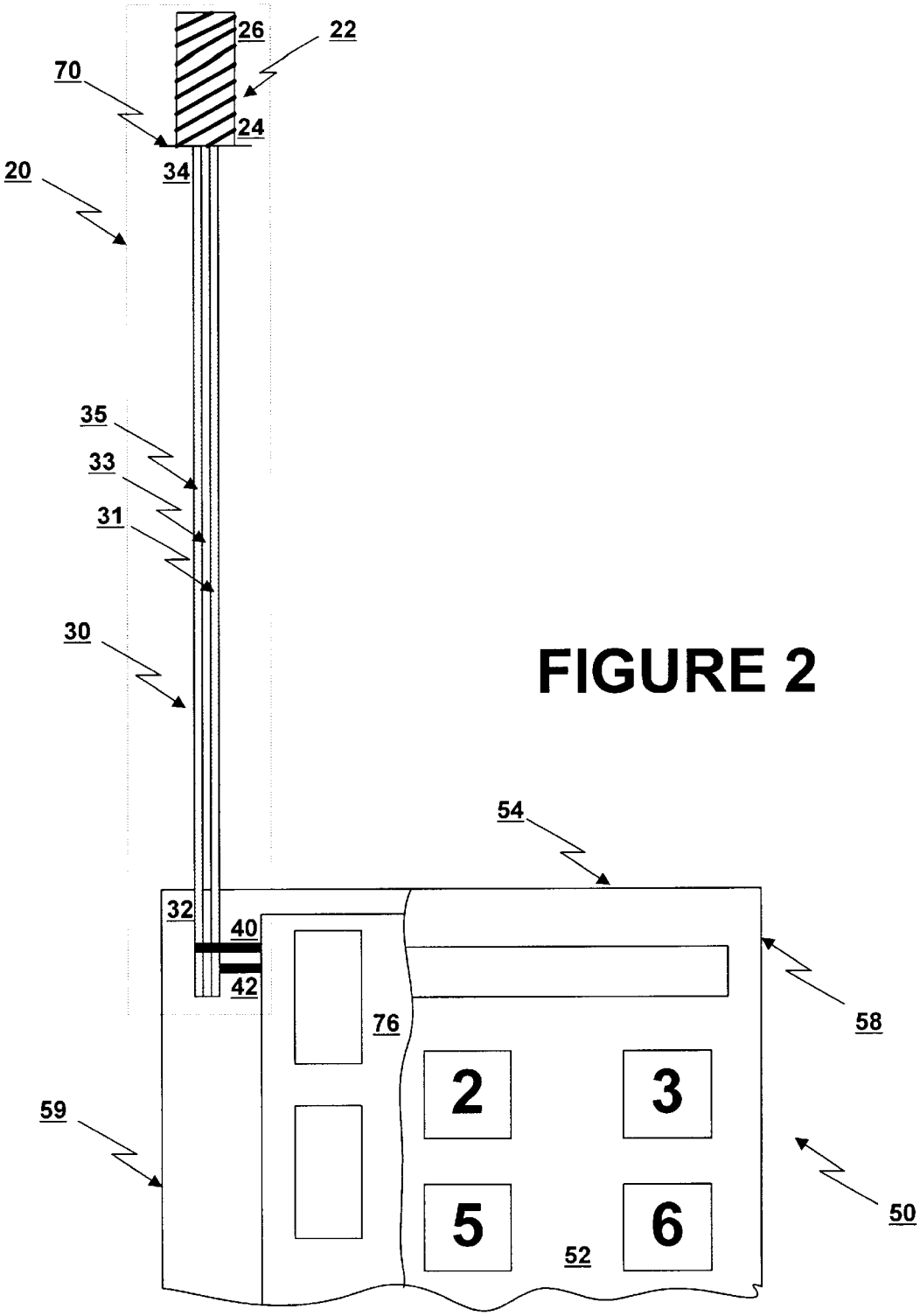
FIG. 2 illustrates an embodiment of the retractable antenna system of the present invention with the antenna in the extended position.
Figure 3:
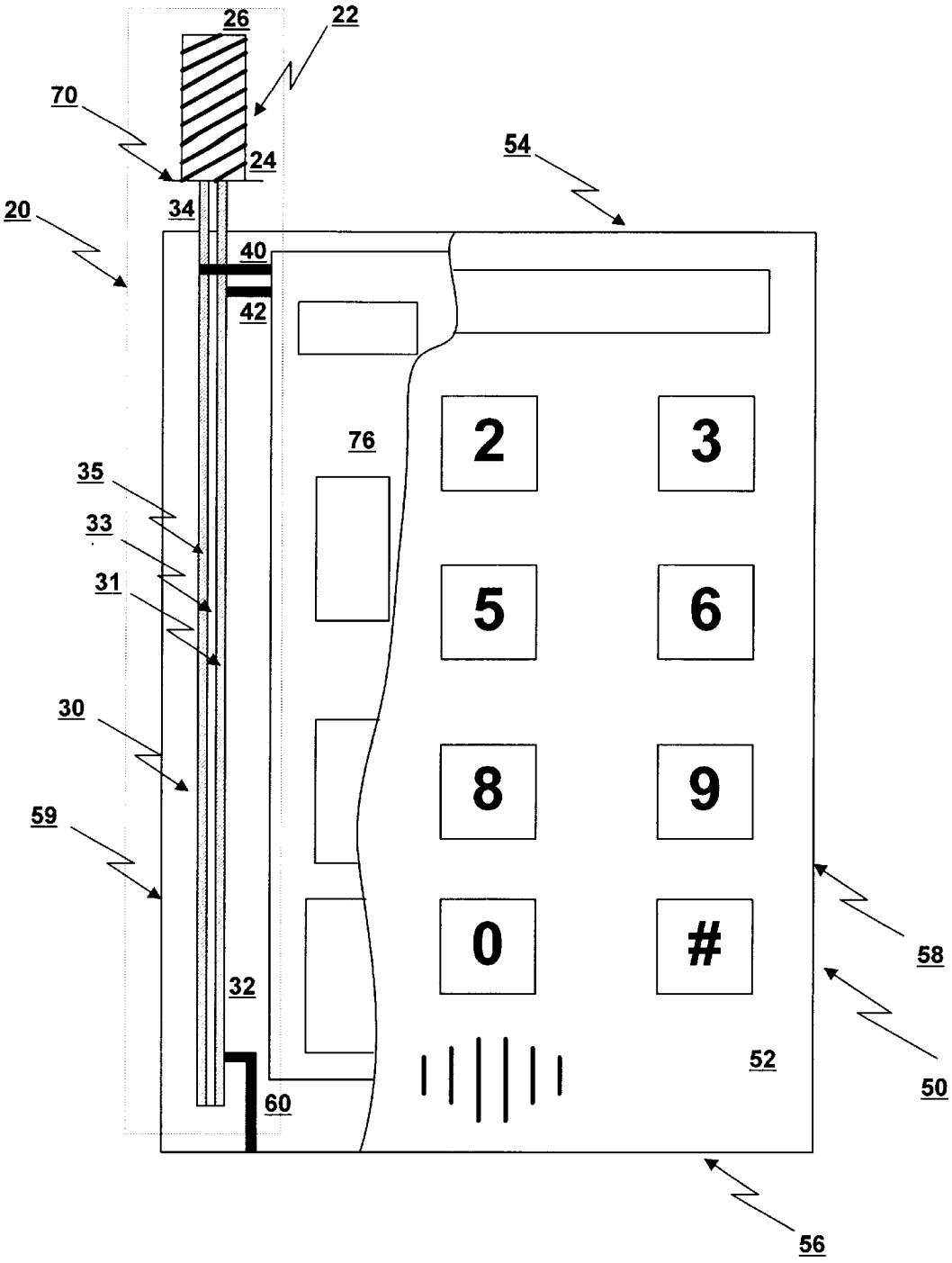
FIG. 3 illustrates the embodiment of FIG. 2 with the antenna in the retracted position.

FIGS. 2 and 3 depict an embodiment of the retractable antenna system 20 of the present invention, with FIG. 2 illustrating the antenna in the extended position and FIG. 3 depicting the antenna in the retracted position. As shown in FIG. 2, radiotelephone 10 includes a housing 50 which includes a front face 52, a top face 54, a bottom face 56 and side faces 58, 59. In the illustrated embodiment, antenna system 20 is generally mounted within housing 50 along the vertical axis extending between top face 54 and bottom face 56 and positioned adjacent to one of the side faces 58, 59. However, as shown in both FIGS. 2 and 3, portions of antenna system 20 may extend outside of housing 50.

As is illustrated in FIGS. 2 and 3, antenna system 20 primarily comprises an antenna 22 and an extendible feed 30 which is electrically coupled to antenna 22. By "extendible" it is meant that feed 30 may be slidably moved into and out of housing 50, so as to vary the length of antenna system 20 which extends external to housing 50 of radiotelephone 10. Herein, the terms "extended position" and/or "extended state" refer to the situation illustrated in FIG. 2, where extendible feed 30 is mostly or completely extended out of housing 50, thereby extending antenna 22 some distance from housing 50. Conversely, as used herein the terms "retracted position" and/or "retracted state" refer to the situation illustrated in FIG. 3, where extendible feed 30 is mostly or completely recessed within housing 50.

In the illustrated embodiment of the present invention, extendible feed 30 has a base 32 and a distal end 34. When antenna 22 is in the retracted position, base 32 of extendible feed 30 is located adjacent the bottom face 56 of housing 50, and distal end 34 of extendible feed 30 is located adjacent the top face 54. As is illustrated in FIG. 2, when antenna 22 is in the extended position, base 32 is adjacent the top face 54 of housing 50, and distal end 34 is external to and displaced from housing 50.

In the embodiment depicted in FIGS. 2 and 3, extendible feed 30 is slidably movable along a vertical axis which runs both within, and external to, housing 50. As illustrated in FIG. 2, when antenna 22 is in the extended position, feed 30 is extended so that it is nearly completely external to housing 50. Conversely, as illustrated in FIG. 3, when antenna 22 is in the retracted position, feed 30 is located almost completely within housing 50, so that antenna 22 appears as a conventionally mounted (i.e., non-retractable) antenna when retracted.

In the embodiment illustrated in FIGS. 2 and 3, antenna 22 remains external to housing 50 in both the extended and retracted positions. However, as will be understood by those of skill in the art, antenna 22 may be physically retracted so as to be positioned partially or even completely within housing 50 when the antenna is in its retracted position and it will still be possible to practice the teachings of the present invention. However, as will also be understood by those of skill in the art, improved performance will typically be achieved where antenna 22 remains external to housing 50 in both the extended and retracted positions, as coupling between the antenna 22 and housing 50 may effectively alter the electrical length of the antenna in the event that the antenna is retracted within the housing 50 of radiotelephone 10.

As is shown in the illustrated embodiment in FIGS. 2 and 3, feed 30 is coupled to transceiver 12 (see FIG. 1) via separate radio frequency 40 and ground 42 connections. These connections 40, 42 preferably are located adjacent the top face 54 of housing 50. In this embodiment of the present invention, feed 30 is coupled to transceiver 12 through connections 40 and 42 when the antenna is in the retracted position and in the extended position. In the embodiment illustrated in FIG. 3, an optional second ground connection 60 is also provided. Preferably, this connection is located adjacent the bottom face 56 of housing 50. Unlike connections 40, 42, connection 60 only contacts extendible feed 30 when antenna 22 is in the retracted position.

Figure 4:
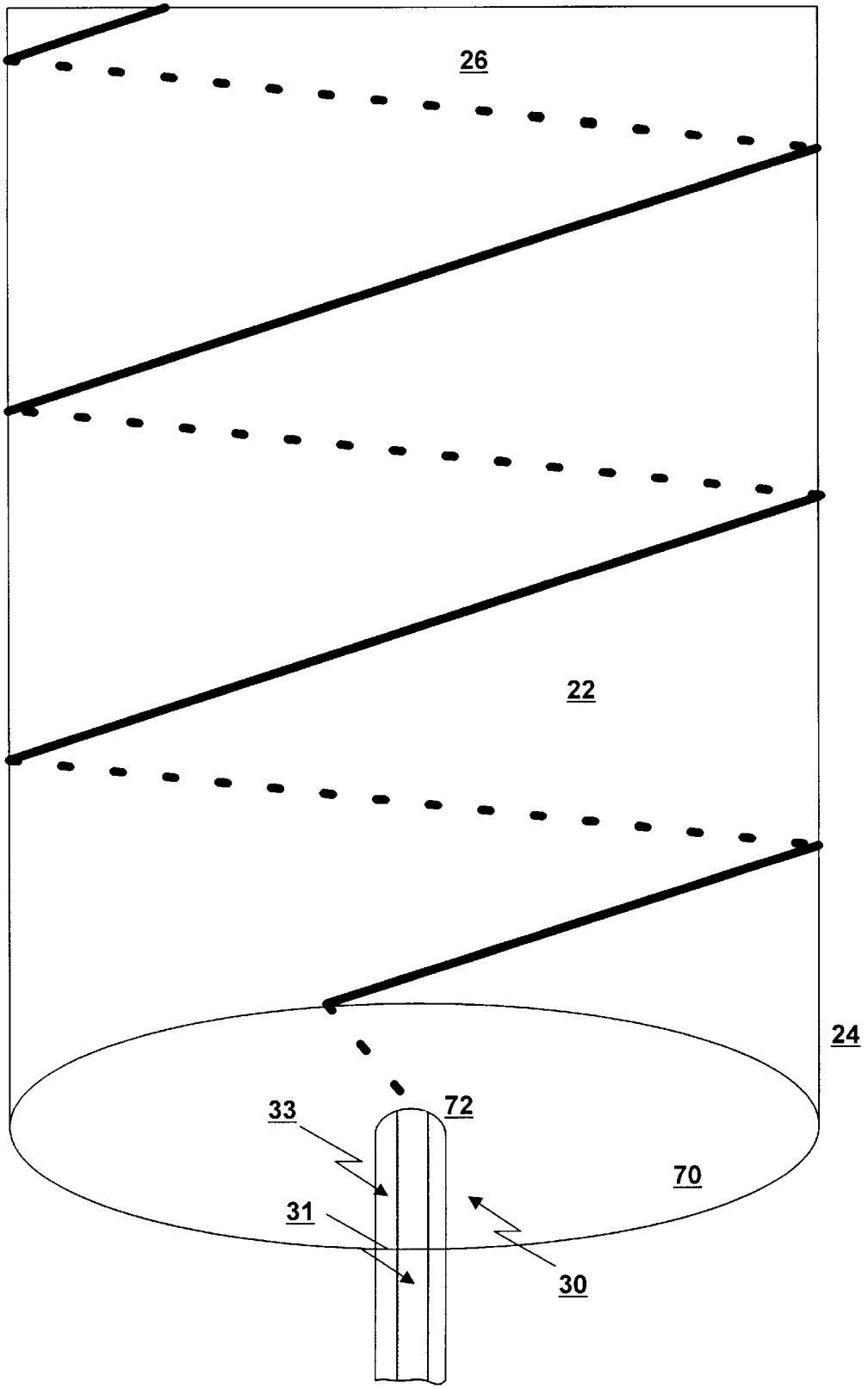
FIG. 4 illustrates the antenna and ground plane in an embodiment of the present invention.

As shown in the embodiment of FIGS. 2 and 3, the base 24 of antenna 22 is directly connected to the distal end 34 of extendible feed 30. Additionally, a conductive disk or plate 70 may optionally be provided adjacent the connection between antenna 22 and extendible feed 30. This disk 70 may be positioned perpendicular to the major axis of extendible feed 30. In this embodiment, disk 70 acts as a ground plane when antenna 22 is in the extended position, as the disk is maintained at the ground voltage associated with the radio frequency signal. As illustrated in FIG. 4, this conductive disk 70 may be mounted directly on extendible feed 30, so that it is movable with extendible feed 30 as extendible feed 30 alternates between the extended and retracted positions. Thus, when extendible feed 30 is in the extended position, ground plane 70 is elevated to a position external to housing 50, and thus serves to isolate antenna 22 from the housing 50 of radiotelephone 10. In the illustrated embodiment, ground plane 70 is attached to extendible feed 30 by including an opening 72 in conductive disk 70 through which the dielectric layer 33 and radio frequency layer 35 may pass so that the radio frequency layer may be directly connected to antenna 22, and, by attaching conductive disk 70, directly to the ground layer 31 of extendible feed 30.

Antenna system 20 may optionally include a protective covering or radome for that portion of the antenna system 20 which extends outside the housing 50. This covering may be implemented according to the present invention as a plastic tube with an end cap. As it is often desirable to minimize the size of the radiotelephone, this radome may be designed to have an inside diameter just large enough to accommodate antenna 22. In such an embodiment, the inside diameter of the radome defines the maximum diameter of conductive disk 70.

When conductive disk 70 is connected directly to extendible feed 30, it retracts and extends with extendible feed 30 when antenna 22 is raised or lowered. Thus, as disk 70 and the ground of the radio frequency feed are at a common potential, conductive disk 70 effectively operates as a ground plane when antenna 22 is in an extended position. However, as conductive disk 70 is typically quite small, the housing 50 of radiotelephone 10, and not conductive disk 70, typically provides the dominate ground plane effect when antenna 22 is in the retracted position.

Extendible feed 30 may be implemented as any of a variety of transmission media, such as coaxial cable, stripline or a microstrip trace. Preferably, extendible feed 30 also serves to provide physical support to antenna 22. However, as will be understood by those of skill in the art, extendible feed 30 need not provide such physical stability, as a separate extendible support structure may, alternatively, be provided.

Figure 5A:
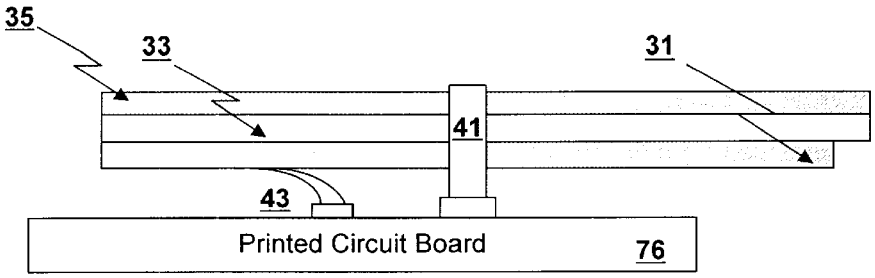
FIG. 5(*a*) is a side view of the extendible non-radiating feed and certain of the connections between it and the radio frequency board in one embodiment of the antenna system of the present invention.
Figure 5B:
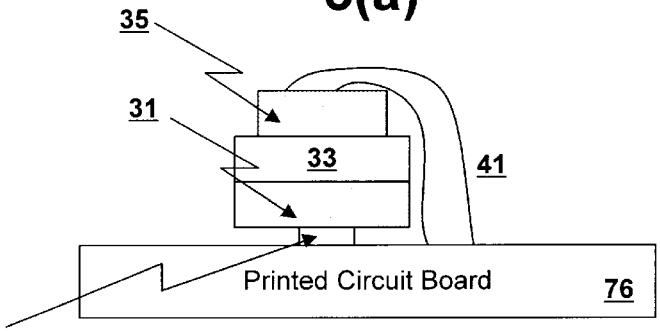
Figure 5C:
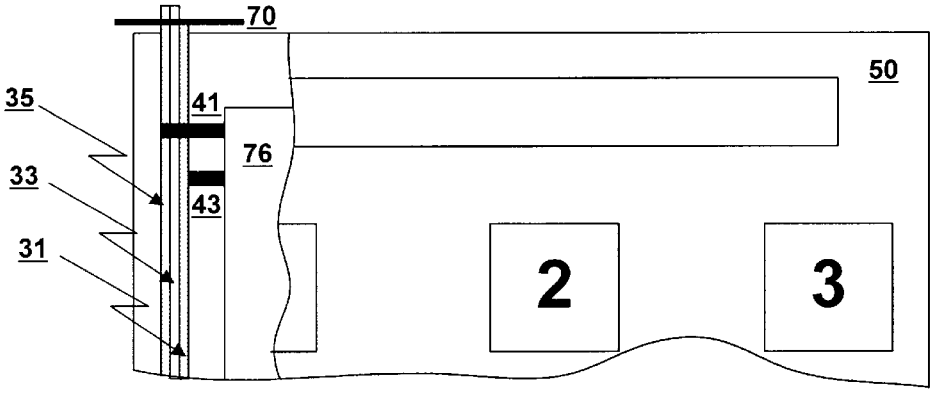

Referring now to FIGS. 5(*a*)–5(*c*), an embodiment of the present invention having an extendible feed 30 which is implemented as a microstrip trace with a characteristic impedance of 50 ohms will be described. As illustrated in FIGS. 5(*a*) (side view), 5(*b*) (top view) and 5(*c*) (front view), this microstrip trace comprises a ground layer 31, a dielectric layer 33 and a "feedline" or "radio frequency" layer 35. The ground layer 31 and the radio frequency layer 35 are each comprised of a strip of electrically conductive material, such as copper, and the dielectric layer 33 may be comprised of any of a variety of dielectric materials which are well known to those of skill in the art, such as polycarbonate, TEFLON, polyeurethane or the like.

As illustrated in FIGS. 5(*a*)–5(*c*), the connections 40, 42 (see FIGS. 2 and 3) between antenna system 20 and transceiver 12 (see FIG. 1) may be implemented as two spring clips 41, 43, which in a the illustrated embodiment are made of brass. Clip 41 provides the radio frequency connection between printed circuit board 76 and the radio frequency layer 35 of extendible feed 30, and, by the spring nature of the clip, this connection may be maintained when extendible feed 30 is slidably moved to extend or retract antenna 22. Similarly, the ground connection is provided by a second clip 43, which is mounted so as to connect the ground lead on printed circuit board 76 and the ground layer 31 of extendible feed 30.

While FIGS. 2, 3 and 5 illustrate an antenna 22 that is directly fed by extendible feed 30, it will be understood by those of skill in the art in light of the present disclosure that, in the retracted position, the connections from printed circuit board 76 can be made directly to antenna 22 as opposed to extendible feed 30. For instance, in the embodiment shown in FIGS. 2 and 5, such a direct connection could be made by retracting extendible feed 30 farther into housing 50, such that the base of antenna 22 contacts clip 41 and such that ground plane 70 comes into contact with clip 43. However, in a preferred embodiment of the present invention, the connections between printed circuit board 76 and antenna 22 are made via extendible feed 30 in both the extended and retracted positions.

Figure 6A:
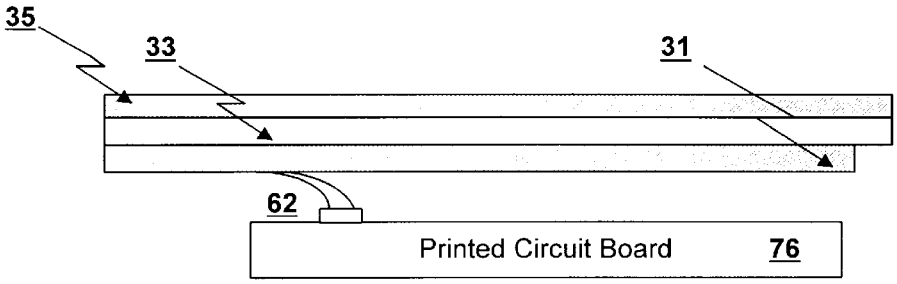
FIG. 6(*a*) is a side view of the extendible non-radiating feed and the remaining ground connection in the embodiment of FIG. 5(*a*)
Figure 6B:
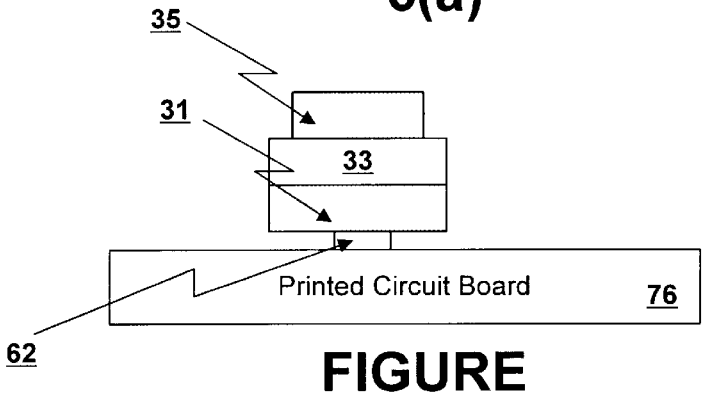
Figure 6C:
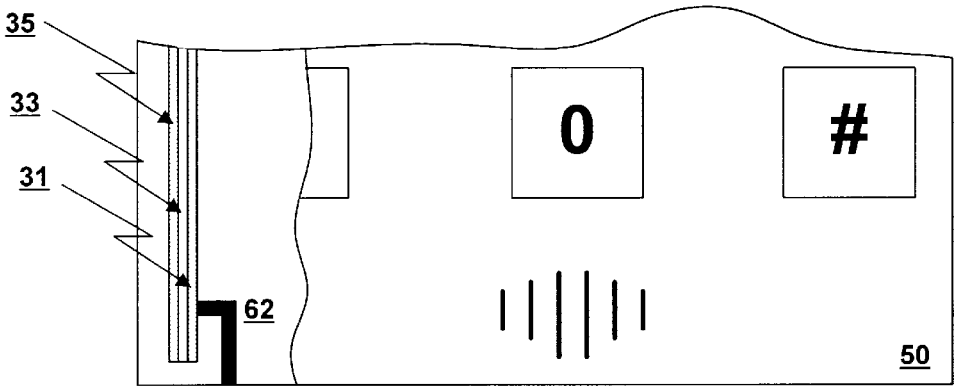

As is illustrated in FIGS. 6(*a*) (side view), 6(*b*) (bottom view) and 6(*c*) (front view), the second ground connection 60 depicted in FIG. 3 may be provided by a third clip 62, which contacts the ground layer 31 of extendible feed 30 when the antenna is in the retracted position. As is illustrated in FIGS. 6(*a*)–6(*c*), one end of clip 62 is typically connected to housing 50 of radiotelephone 10 (to provide the ground reference), and the other end is positioned so that it engages the base of extendible feed 30 along ground layer 31 when the antenna system is in the retracted position. However, clip 62 is positioned in such a way that it will not engage extendible feed 30 when antenna 22 is in the extended position. In this manner, clip 62 open circuits that portion of extendible feed 30 located below connections 40, 42 when antenna 22 is in the retracted position, and is disengaged when antenna 22 is in the extended position. Thus, this additional ground connection 60 serves to reduce the impact retracted feed 30 has on the impedance seen at the base of antenna 22, and further acts as a tuning element as the impedance varies as a function of the location of the connction 60. As is also illustrated in FIGS. 6(*a*)–6(*c*), the radio frequency lead 35 at the base of extendible feed 30 is left loose (i.e., it is not connected to anything within housing 50).

While connections 40, 42, 60 are depicted as brass clips in the illustrated embodiments, it will be understood by those of skill in the art that a wide variety of connectors may be used to implement connections 40, 42, 60, such as contact chips, plugs or any other conventional method for creating a direct electrical connection. Accordingly, the present invention is not limited to the clip embodiment illustrated in the figures, but is intended to encompass a wide variety of connection means which establish electrical connections between extendible feed 30 and transceiver 12 and/or a reference potential.

Antenna system 20 operates as follows. When antenna 22 is in the extended position, clip 41 engages the radio frequency layer of extendible feed 30, and clip 43 engages the ground layer 31, thereby providing a radio frequency connection between printed circuit board 76 and extendible feed 30. Signals which are to be transmitted are provided by transceiver 12 on printed circuit board 76 to extendible feed 30 via clips 41, 43, and are carried by extendible feed 30 to antenna 22 for transmission. As discussed above, extendible feed 30 is preferably a non-radiating structure, and, hence, it does not appreciably radiate or receive electromagnetic energy. Moreover, by inclusion of ground plane 70, the tendency of electromagnetic energy to couple from antenna 22 to radiotelephone 10 is further diminished, thereby increasing the efficiency of antenna system 20.

When antenna 22 is in the retracted position, clips 41 and 43 still engage extendible feed 30, this time adjacent the distal end 34, so as to provide a radio frequency connection between printed circuit board 76 and extendible feed 30. However, the ground layer 31 near the base end 32 of extendible feed 30 further engages clip 62, which effectively grounds the portion of extendible feed 30 falling below the connections 40, 42. This serves to minimize the effect this portion of extendible feed 30 may have on the performance of antenna 22, and, by strategic placement of the location of the ground connection, it is possible to sufficiently minimize these effects.

As discussed above, in one embodiment of the present invention, antenna 22 is implemented as a quarter-wavelength helix with a natural impedance on the order of 50 ohms. In this manner, antenna 22 may be inherently matched to the 50 ohm microstrip trace 14 which is used to couple transceiver 12 to antenna system 20. Moreover, as extendible feed 30 is a non-radiating structure, antenna 22 operates as a quarter-wavelength antenna in both the extended and retracted positions, and, thus, the impedance seen at the base of antenna 22 is approximately the same (50 ohms) when the antenna is in either the extended or the retracted positions. Accordingly, pursuant to the teachings of the present invention, it is possible to match the impedance of antenna 22 to the impedance of microstrip trace 14 in both the extended and retracted positions, without the need for any matching components.

The retractable antenna systems of the present invention are particularly well-suited for use in "dual-band" radiotelephones which must operate in two (or more) widely separated frequency bands. As discussed above, such radiotelephones conventionally may require as many as four separate matching circuits, as it is necessary to match the antenna to the feed in both the extended and retracted positions, and as, typically, separate matching networks are required for each frequency band in which the antenna operates. Moreover, in dual-band radiotelephones, ground currents tend to minimize the gain in at least one of the operating bands if the antenna is in close proximity to the phone when operating in the extended position.

The retractable antenna systems of the present invention overcome each of these problems with conventional dual-band antenna systems. Specifically, the need for matching networks may be avoided altogether in many instances, as it is possible in many cases to experimentally vary a number of parameters such as the length of extendible feed 30, the location of ground connection 60 and the size of conductive disk 70 such that acceptable impedance matching is achieved in both bands of operation in both the retracted and extended positions, without the need for any active matching components. In one such embodiment, extendible feed 30 is approximately one-quarter the wavelength corresponding to the center frequency of the lower of the two frequency bands in which the radiotelephone is designed to operate, the ground connection 60 is made near the base 32 of extendible feed 30, and the diameter of conductive disk 70 is the largest diameter which will fit inside the radome covering antenna 22. However, many variations from this designs will also provide acceptable performance, and the necessary experiments to select such parameters is within the skill of one of ordinary skill in the art given the teachings of the present disclosure. Additionally, by elevating the radiating components several centimeters above the housing 50 of radiotelephone 10 and through the provision of an extendible ground plane 70, it is possible to minimize the effects of ground currents and, hence, reduce their impact on gain loss.

Figure 7:
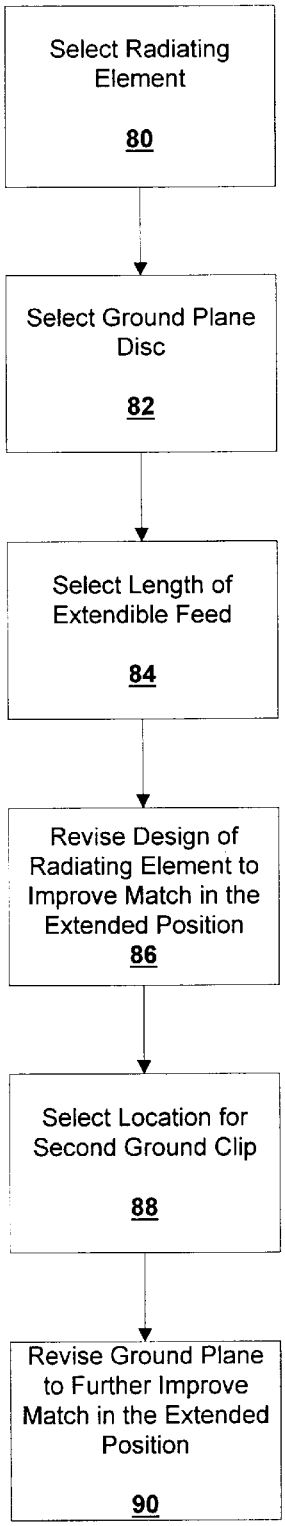
FIG. 7 is a flow chart illustrating a methodology for designing antenna systems according to the present invention.

In another aspect of the present invention, methods of designing antenna system 20 are disclosed. An embodiment of these methodologies is depicted in FIG. 7. As illustrated in FIG. 7, the radiating element 22 is first designed in isolation (step 80). Typically, the type and characteristics of antenna 22 are chosen based on the required gain performance of the antenna, antenna size and cost considerations, and the impedance of the associated antenna feed. Next (step 82), an upper limit on the size of conductive disk 70 is selected, typically as the maximum size that will fit within the radome enclosing the antenna. Then (step 84), the length of extendible feed 30 is selected, primarily based on the available room within the housing 50 of radiotelephone 10.

After initial selections are made for the antenna 22, ground plane 70 and extendible feed 30, the impedance match in the extended position may be measured, and, if necessary, the specific design of the radiating element (e.g., modify the location of a parasitic element on a dual-band helix antenna) is revised to improve the impedance match in the extended position (step 86). The impedance match in the retracted position is then optimized by adjusting the location of ground connection 60 within the housing 50 (step 88). Finally, the impedance match in the extended position may be revisited, and, if further adjustment is required, the size of the ground plane disk 70 may be altered or cups may be added to the disc (step 90). In the event further compromise is required to meet impedance match specifications, performance is preferably optimized in the extended position at the expense of performance in the retracted position.

As will be understood by those of skill in the art, the amount of capacitive coupling which occurs between antenna system 20 and radiotelephone 10 depends primarily upon the distance between the radiating structure (antenna 22) and radiotelephone 10. Accordingly, to the extent this distance can be increased, the capacitive coupling effects are correspondingly reduced. By mounting the radiating structure upon a non-radiating, extendible feed line 30, it is possible to separate the radiating structure from housing 50 by several centimeters or more, substantially increasing the isolation between antenna 22 and housing 50. This advantageously minimizes the performance degradation which typically results from such capacitive coupling effects.

As will also be understood by those of skill in the art, similar electromagnetic coupling can occur between antenna 22 and the user of radiotelephone 10. However, once again, such electromagnetic coupling may be advantageously reduced by increasing the distance between the radiating structure and the top of the radiotelephone.

EXAMPLE

A dual-band helix antenna has been constructed according to the teachings of the present invention. The antenna system 20 includes an 80 millimeter extendible feed 30, and has a small, 10 millimeter diameter ground plane disc 70 attached to the ground side of feed 30. The helix antenna has approximately 9 windings and has a diameter of 8 millimeters and an axial length of approximately 30 millimeters. Dual-band operation is achieved through the use of a 15 millimeter parasitic element positioned just outside the middle windings of the helix and parallel to its center axis. Extendible feed 30 was constructed as a microstrip trace comprised of copper ground 31 and radio frequency layers 35 separated by an FR4 PCB board dielectric layer 33 (dielectric constant 4.5–4.9). Connections 40, 42, 60 were implemented as brass spring clips similar to the clips depicted in FIGS. 5 and 6. Clips 41 and 43 were located approximately 4 millimeters and 5 millimeters, respectively, from the top face 54 of housing 50, and clip 62 was positioned approximately 5 millimeters from the base 32 of extendible feed 30.

In the drawings, specification and examples, there have been disclosed typical preferred embodiments of the invention and, although specific terms are employed, these terms are used in a generic and descriptive sense only and not for purposes of limitation, the scope of the invention being set forth in the following claims. Accordingly, those of skill in the art will themselves be able to conceive of embodiments of the retractable antenna systems and radiotelephones other than those explicitly described herein without going beyond the scope of the present invention.

That which is claimed is:

1. A radiotelephone having a retractable antenna system comprising:

a housing;

a transceiver disposed within said housing;

a user interface electrically coupled to said transceiver;

a non-radiating antenna support structure movably mounted within said housing and extendible from said housing so as to have an extended position and a retracted position, said non-radiating antenna support structure including an antenna feed that is coupled to said transceiver and having a distal end;

an antenna electrically coupled to said antenna feed; and a ground plane connected adjacent the distal end of said non-radiating antenna support structure and movable with said non-radiating antenna support structure;

wherein said antenna is connected to said non-radiating antenna support structure adjacent the distal end of said non-radiating antenna support structure and is moveable with said non-radiating antenna support structure so as to substantially isolate said antenna from said housing when said antenna is in said extended position.

2. The radiotelephone of claim 1, wherein said antenna is fed by said antenna feed at a point external to the housing of said radiotelephone when said antenna is in the retracted position.

3. The radiotelephone of claim 1, wherein said antenna feed comprises a microstrip antenna feed having a radio frequency layer and a ground layer, and wherein said antenna is electrically coupled to the radio frequency layer of said antenna feed, and said ground plane is electrically connected to said ground layer of said antenna feed.

4. A retractable dual-band antenna system for a radiotelephone having a housing and a transceiver, comprising:

a dual-band antenna configured so as to radiate in a selected one of two separate frequency bands;

a non-radiating antenna support structure having a distal end movably mounted within the housing and extendible from the housing so as to have an extended position and a retracted position, said non-radiating antenna support structure including an antenna feed that is electrically connected to said transceiver and said dual-band antenna, and wherein said connection between said non-radiating feed and said dual-band antenna is external to the housing of the radiotelephone when said non-radiating antenna support structure is in said extended position; and a ground plane connected adjacent the distal end of said non-radiating antenna support structure and movable with said non-radiating antenna support structure.

5. A retractable antenna system for a radiotelephone having a housing and a transceiver, comprising:

a non-radiating feed movably mounted within the housing and extendible from the housing so as to have an extended position and a retracted position;

an antenna electrically coupled to said non-radiating feed;

connection means for electrically coupling said non-radiating feed to the transceiver of said radiotelephone; and a ground plane disposed between the base of said antenna and the distal end of said non-radiating feed and movable with said non-radiating feed.

6. The antenna system of claim 5, further comprising grounding means switchably coupled with said antenna feed for grounding said antenna feed when said non-radiating antenna support structure is in said retracted position.

7. The antenna system of claim 5, wherein said antenna is physically supported by said non-radiating antenna support structure, and wherein said antenna is mounted in an extended state when said non-radiating antenna support structure is in said extended position and wherein said antenna is mounted in a retracted state when said non-radiating antenna support structure is in said retracted position.

8. The antenna system of claim 7, wherein said antenna is fed by said antenna feed at a point external to the housing of the radiotelephone when said antenna operates in said extended state.

9. The antenna system of claim 7, wherein said ground plane is located external to the radiotelephone when said antenna is in said extended state.

10. The antenna system of claim 7, wherein said antenna exhibits approximately the same electrical length in both said extended state and said retracted state.

11. The antenna system of claim 5, wherein said non-radiating antenna feed comprises first and second feed lines, and wherein said first feed line is electrically connected to said antenna and said second feed is electrically connected to said ground plane.

12. The antenna system of claim 5, wherein said antenna is fed by said non-radiating antenna feed at a point external to the housing of said radiotelephone when said antenna is in the retracted position.

13. A method of designing a retractable antenna system for a radiotelephone having an extendible non-radiating antenna feed and a ground connection for open circuiting a portion of the extendible non-radiating antenna feed, the method comprising the steps of:

selecting a radiating element;

selecting an extendible non-radiating antenna feed;

measuring the impedance match between the radiating element and the antenna feed when the antenna is in an extended position;

revising the design of the radiating element to improve the impedance match between the radiating element and the antenna feed when the antenna is in the extended position;

measuring an impedance match between the radiating element and the antenna feed when the antenna is in a retracted position; and selecting a location along the length of the extendible non-radiating antenna feed for the ground connection so as to improve the impedance match between the radiating element and the antenna feed when the antenna is in the retracted position.

14. The method of claim 13, wherein the retractable antenna system further comprise a ground plane that is connected adjacent the distal end of the extendible non-radiating antenna feed and is moveable with the extendible non-radiating antenna feed, and wherein said method further comprises the step of selecting the size of the ground plane to improve the impedance match between the radiating element and the antenna feed when the antenna is in the extended position.

* * * * *